US011725550B2

(12) United States Patent
Mihara

(10) Patent No.: US 11,725,550 B2
(45) Date of Patent: Aug. 15, 2023

(54) CONTROL METHOD, CONTROLLER, AND CONTROL PROGRAM FOR CONTROLLING LUBRICATING SYSTEM, COMPUTER-READABLE MEDIUM CARRYING CONTROL PROGRAM, LUBRICATING SYSTEM, AND VEHICLE

(71) Applicant: VOLVO TRUCK CORPORATION, Gothenburg (SE)

(72) Inventor: Masato Mihara, Saitama (JP)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/911,704

(22) PCT Filed: Mar. 16, 2020

(86) PCT No.: PCT/JP2020/011421
§ 371 (c)(1),
(2) Date: Sep. 15, 2022

(87) PCT Pub. No.: WO2021/186496
PCT Pub. Date: Sep. 23, 2021

(65) Prior Publication Data

US 2023/0125940 A1 Apr. 27, 2023

(51) Int. Cl.
*F01P 5/00* (2006.01)
*F01M 5/00* (2006.01)
(Continued)

(52) U.S. Cl.
CPC ..... *F01M 5/005* (2013.01); *F01P 3/20* (2013.01); *F01P 7/16* (2013.01); *F01M 2250/60* (2013.01);
(Continued)

(58) Field of Classification Search
CPC ..... F01M 3/0005; F01M 2250/70; F01P 3/20; F01P 2025/40
See application file for complete search history.

(56) References Cited

U.S. PATENT DOCUMENTS 6,530,347 B2 * 3/2003 Takahashi ..... F01P 7/167 123/41.31
2004/0112171 A1 * 6/2004 Kuhstrebe ..... F16H 61/688 903/945
(Continued)

FOREIGN PATENT DOCUMENTS

JP 10141036 A 5/1998
JP 2004232514 A 8/2004
(Continued)

OTHER PUBLICATIONS

International Search Report and Written Opinion of the International Searching Authority, PCT/JP2020/011421, dated Jun. 9, 2020, 7 pages.

*Primary Examiner* — Long T Tran
(74) *Attorney, Agent, or Firm* — Sage Patent Group

(57) ABSTRACT

A lubricating system of an engine equipped with an idle reduction system includes an oil cooler, a remotely operable valve configured to open and close a bypass passage that bypasses the oil cooler, and an electronic control unit. The electronic control unit is configured to perform the steps of: controlling the valve so that a temperature of lubricating oil approaches a target temperature; and lowering the target temperature when an average torque of the engine is less than a predetermined threshold.

14 Claims, 8 Drawing Sheets

(51) Int. Cl.
*F01P 3/20* (2006.01)
*F01P 7/16* (2006.01)
*F01P 7/14* (2006.01)

(52) U.S. Cl.
CPC ..... *F01P 2007/146* (2013.01); *F01P 2025/40* (2013.01); *F01P 2060/04* (2013.01)

(56) References Cited

U.S. PATENT DOCUMENTS

| | | | | |
|---|---|---|---|---|
| 2011/0132012 | A1* | 6/2011 | Heindl ..... | F15B 21/0423<br>62/196.1 |
| 2015/0176472 | A1* | 6/2015 | Hutchins ..... | F01P 7/165<br>701/102 |

FOREIGN PATENT DOCUMENTS

| | | | |
|---|---|---|---|
| JP | 2010236693 | A | 10/2010 |
| JP | 2012132351 | A | 7/2012 |
| JP | 2017133456 | A | 8/2017 |

* cited by examiner

[FIG. 3]
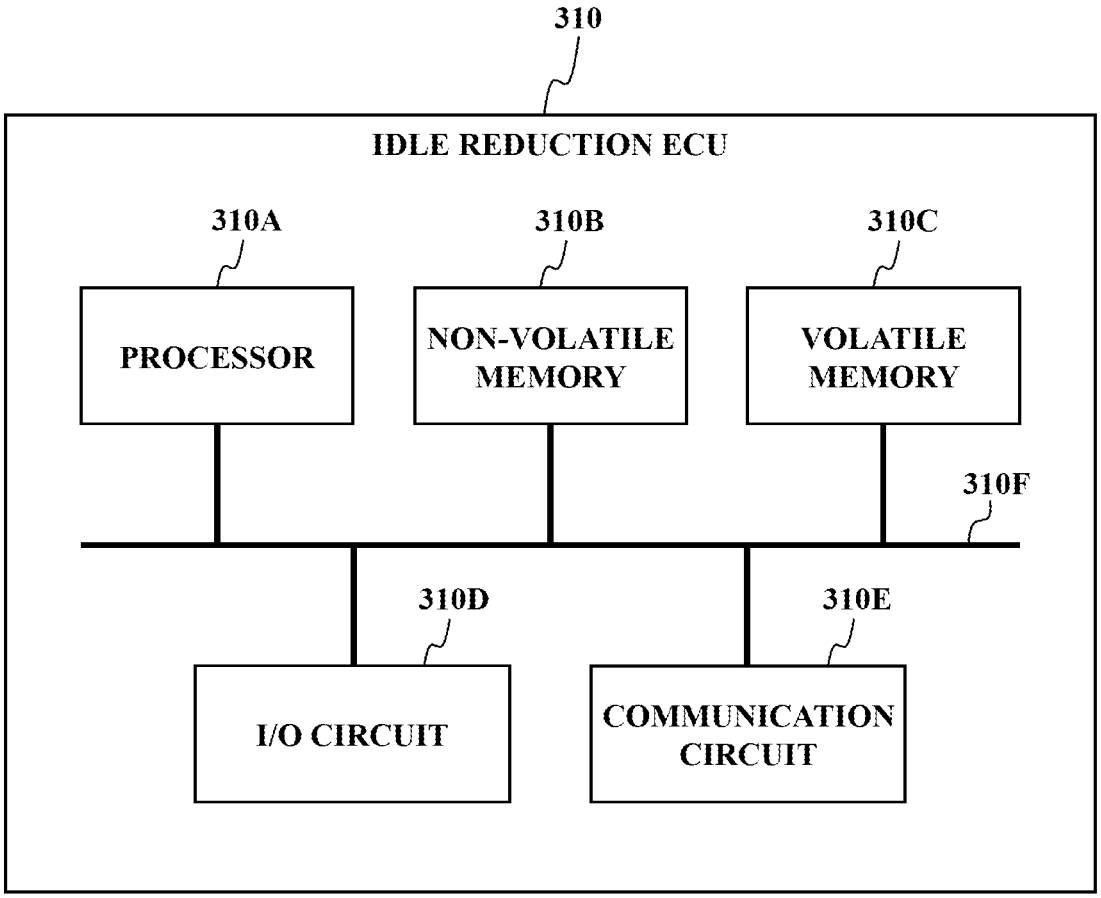

[FIG. 4]
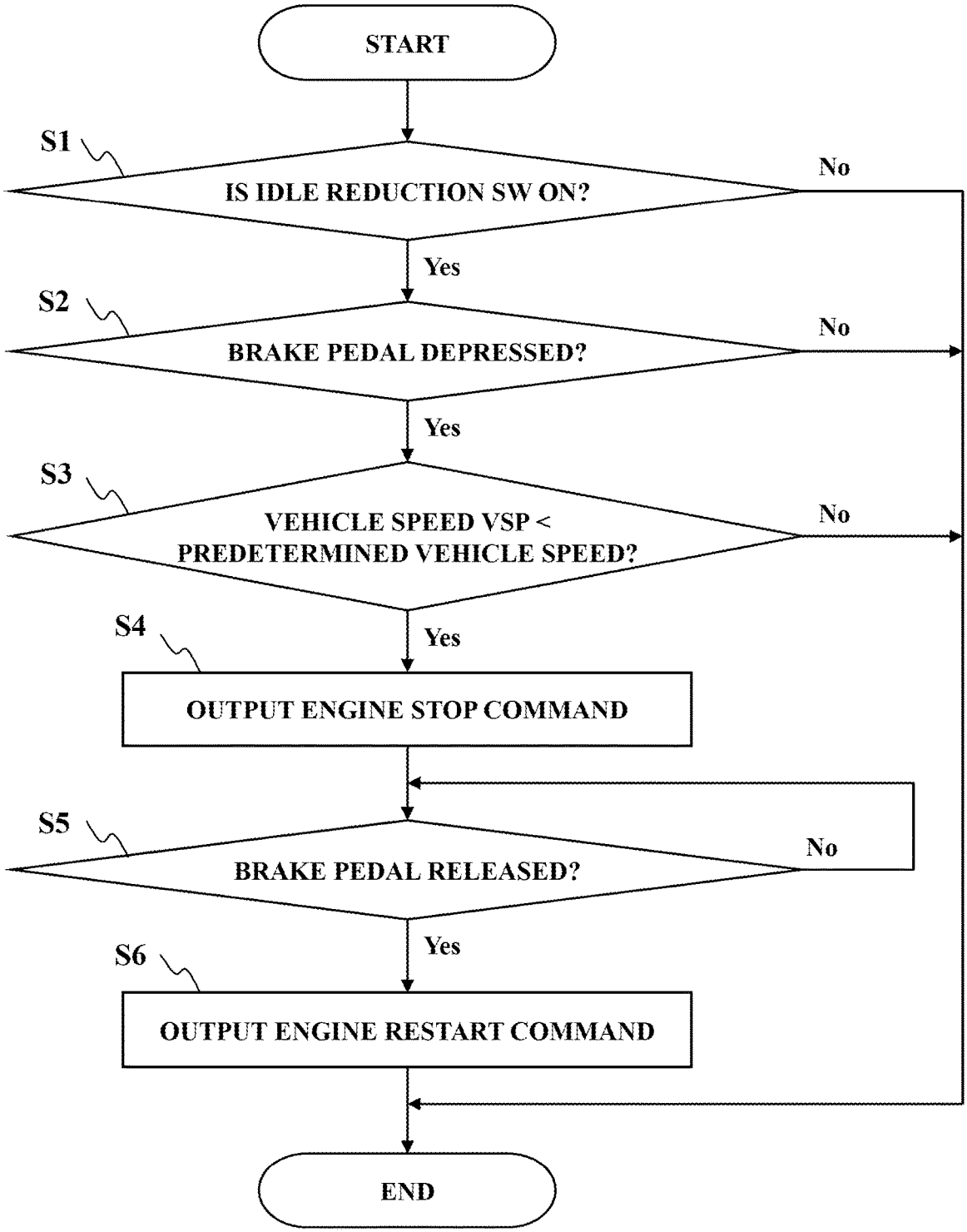

[FIG. 5]
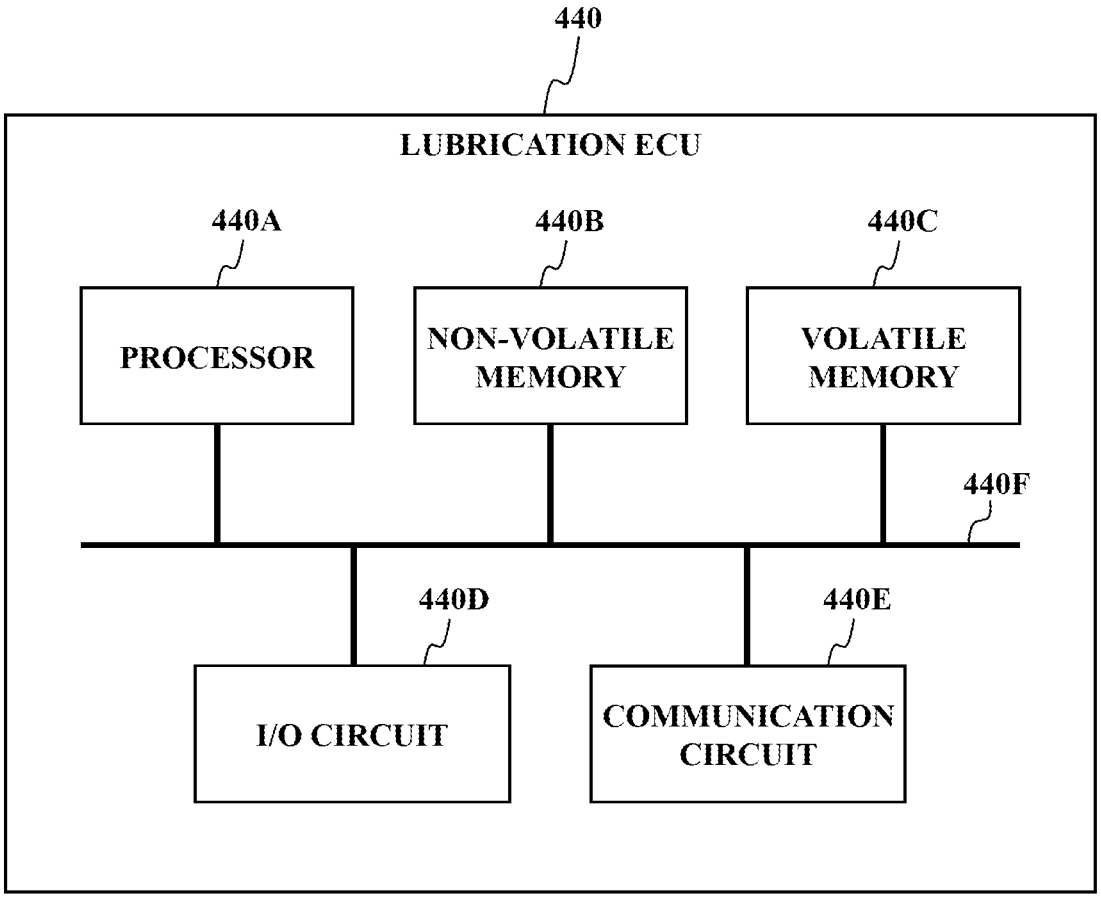

[FIG. 6]
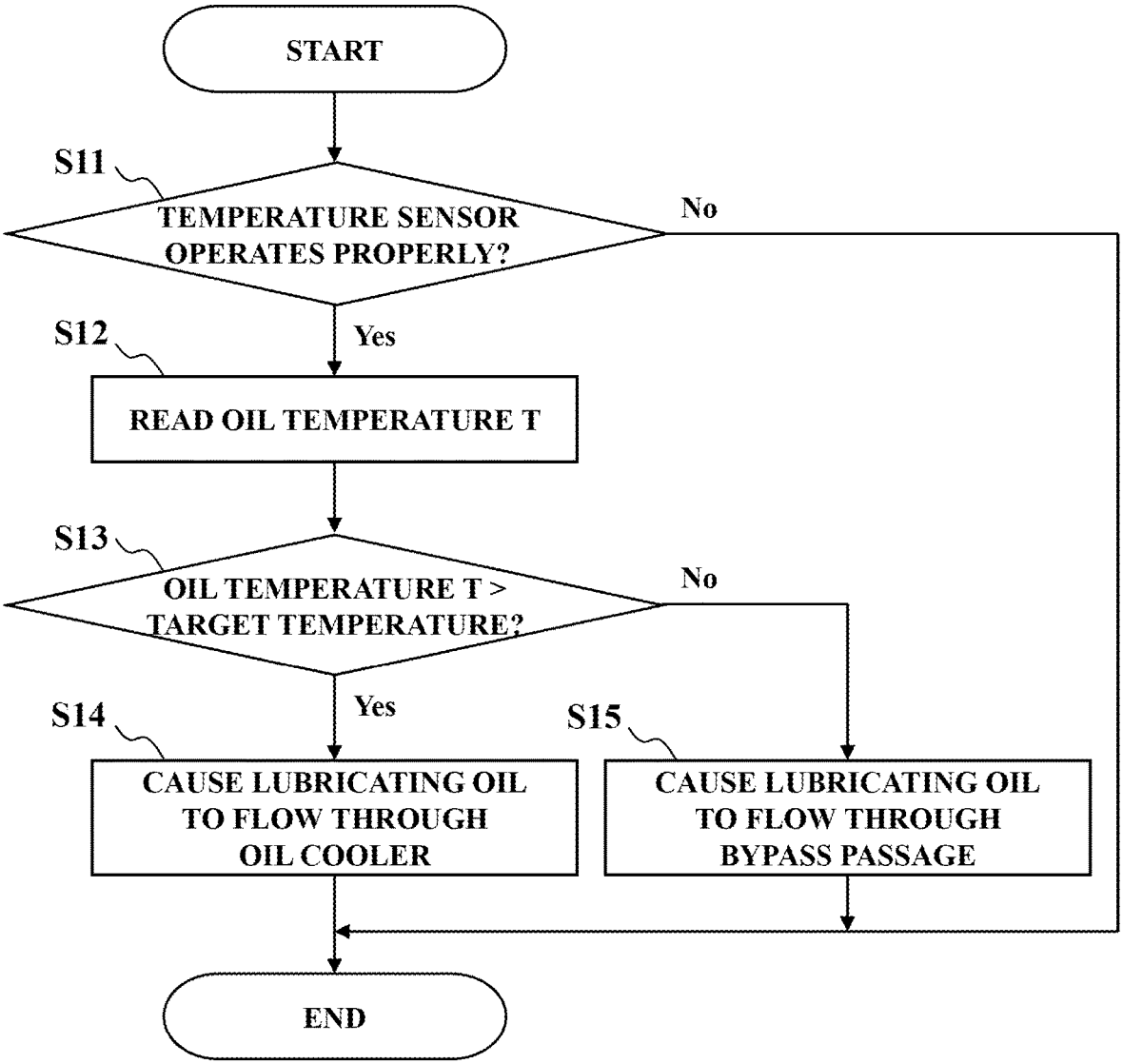

[FIG. 7]
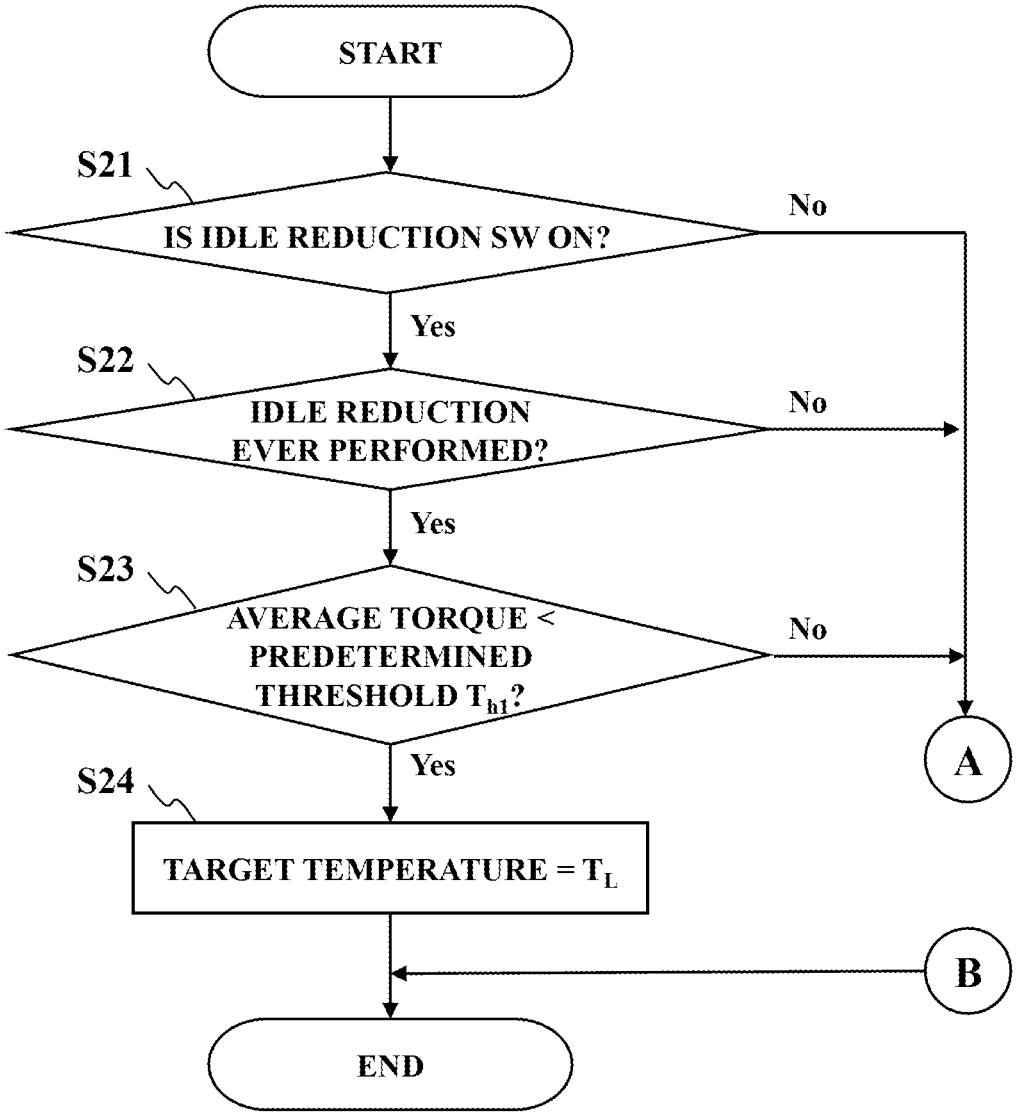

[FIG. 8]
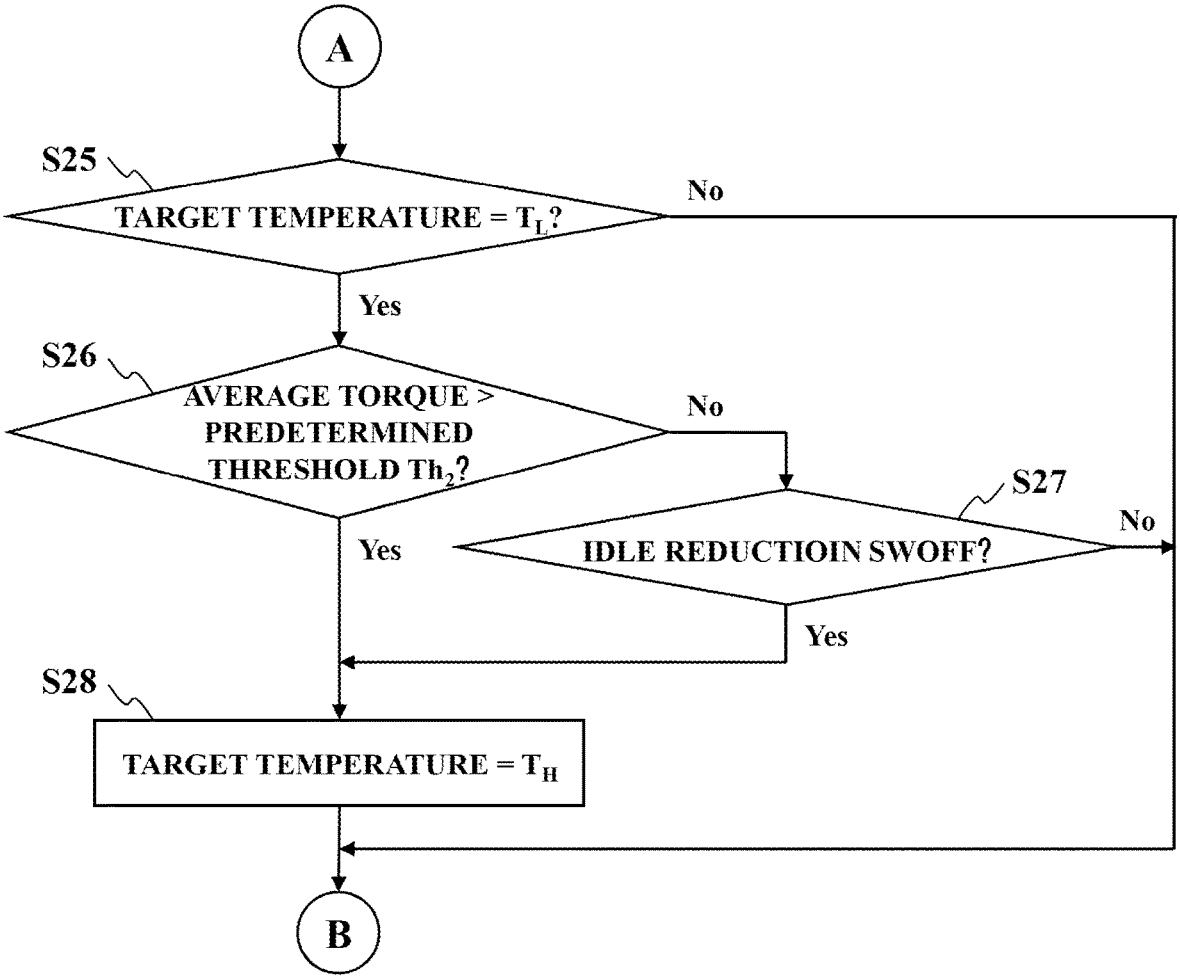

CONTROL METHOD, CONTROLLER, AND CONTROL PROGRAM FOR CONTROLLING LUBRICATING SYSTEM, COMPUTER-READABLE MEDIUM CARRYING CONTROL PROGRAM, LUBRICATING SYSTEM, AND VEHICLE

CROSS REFERENCE TO RELATED APPLICATIONS

This application is a 35 U.S.C. § 371 national stage application of PCT International Application No. PCT/JP2020/011421 filed on Mar. 16, 2020, the disclosure and content of which is incorporated by reference herein in its entirety.

TECHNICAL FIELD

The present invention relates to a control method, a controller, and a control program for controlling a lubricating system of an engine equipped with an idle reduction system (idle stop system), and a computer-readable medium carrying the control program. Furthermore, the present invention also relates to a lubricating system of an engine equipped with an idle reduction system, and a vehicle equipped with the lubricating system.

BACKGROUND ART

As disclosed in JP 2010-236693 A, a lubricating system in a vehicle prevents excessive cooling of lubricating oil by opening and closing a valve disposed in a bypass passage that bypasses an oil cooler in accordance with the temperature of the lubricating oil. In particular, the lubricating system may control the temperature of the lubricating oil at a relatively high level to reduce friction in the engine and thus to improve fuel economy.

SUMMARY

Recently, many vehicles are equipped with idle reduction systems configured to stop the engine while the vehicle is parking, stopping, or waiting for a traffic light so as to achieve fuel saving and emission reduction. Such an idle reduction system is configured to detect a decrease in vehicle speed and stop the engine, and then to detect a driver's vehicle start operation and restart the engine. Here, the viscosity of the lubricating oil decreases as the temperature thereof increases. Thus, if the temperature of the lubricating oil is controlled at a relatively high level in such a vehicle equipped with an idle reduction system, it may take longer to sufficiently increase the pressure of the lubricating oil right after the engine is restarted by idle reduction. If it takes longer to sufficiently increase the pressure of the lubricating oil, the engine may be restarted while the movable components such as bearings have not yet been sufficiently lubricated and this may accelerate the wear of these movable components.

Therefore, an object of the present invention is to provide a control method, a controller, and a control program for controlling a lubricating system of an engine which are capable of rapidly increasing the pressure of lubricating oil right after the engine is restarted by an idle reduction system, and a computer-readable medium carrying the control program. Another object of the present invention is to provide a lubricating system of an engine capable of rapidly increasing the pressure of lubricating oil right after the engine is restarted by an idle reduction system, and a vehicle equipped with the lubricating system.

A lubricating system of an engine equipped with an idle reduction system includes an oil cooler, a remotely operable valve configured to open/close a bypass passage that bypasses the oil cooler, and an electronic control unit. The electronic control unit is configured to perform the steps of: controlling the valve so that a temperature of lubricating oil approaches a target temperature; and lowering the target temperature when an average torque of the engine is less than a predetermined threshold. A program for controlling a lubricating system includes a program code for performing at least the steps of controlling the valve and lowering the target temperature. A computer-readable medium carries a program for controlling a lubricating system, and the program includes a program code for performing at least the steps of controlling the valve and lowering the target temperature. A vehicle is equipped with the lubricating system described above.

According to the present invention, it is possible to rapidly increase the pressure of the lubricating oil right after the engine is restarted by the idle reduction system.

BRIEF DESCRIPTION OF DRAWINGS

FIG. 3 is a block diagram of an example of an electronic idle reduction control unit.

FIG. 4 is a flowchart illustrating an example of idle reduction control processing.

FIG. 5 is a block diagram of an example of an electronic lubrication control unit.

FIG. 6 is a flowchart illustrating an example of lubricating oil temperature control processing.

FIG. 7 is a flowchart illustrating an example of target temperature changing processing.

FIG. 8 is a flowchart illustrating an example of target temperature changing processing.

DESCRIPTION OF EMBODIMENTS

Hereinafter, an embodiment for implementing the present invention will be described in detail with reference to the accompanying drawings.

Figure 1:
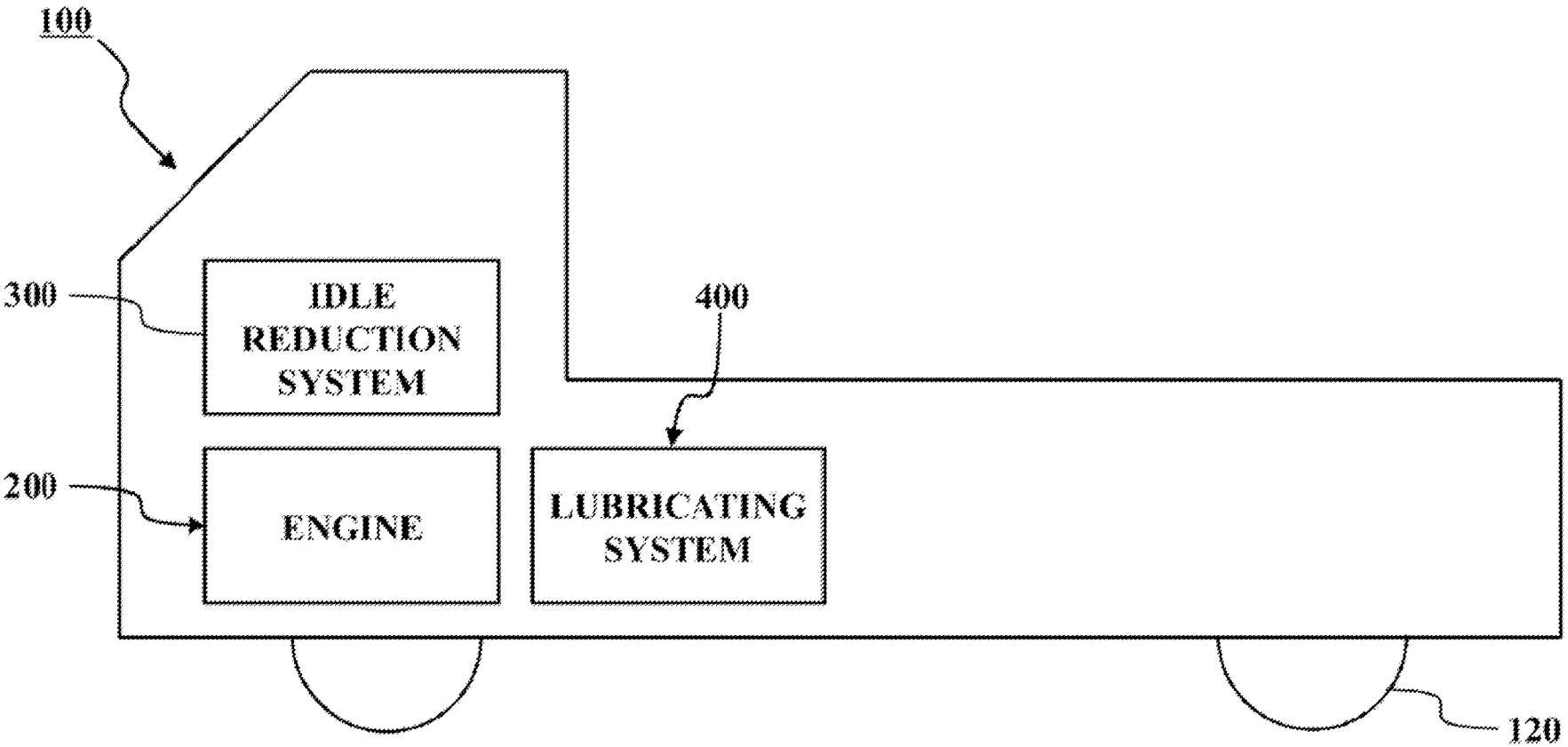
FIG. 1 is a schematic diagram of an example of a vehicle to which the present invention is applicable.

FIG. 1 shows an example of a vehicle to which the present invention is applicable. The following description will be made using a truck 100 as an example of such a vehicle. However, the vehicle is not limited to the truck 100 and may be another vehicle such as a bus, a passenger car, or a construction machine.

The truck 100 includes an engine 200, an idle reduction system 300, and a lubricating system 400 for the engine 200. The engine 200 is configured to drive rear wheels 120 by means of a clutch and a transmission (not shown). A diesel engine may be used as the engine 200 for the truck 100, but a gasoline engine may be used as the engine 200 for a passenger car or the like. The idle reduction system 300 is configured to detect a decrease in vehicle speed and stop the engine, and then to detect a driver's vehicle start operation and restart the engine, so as to achieve fuel saving and emission reduction. The lubricating system 400 supplies lubricating oil to movable components, such as bearings and a valvetrain, of the engine 200 so as to lubricate the movable components.

Figure 2:
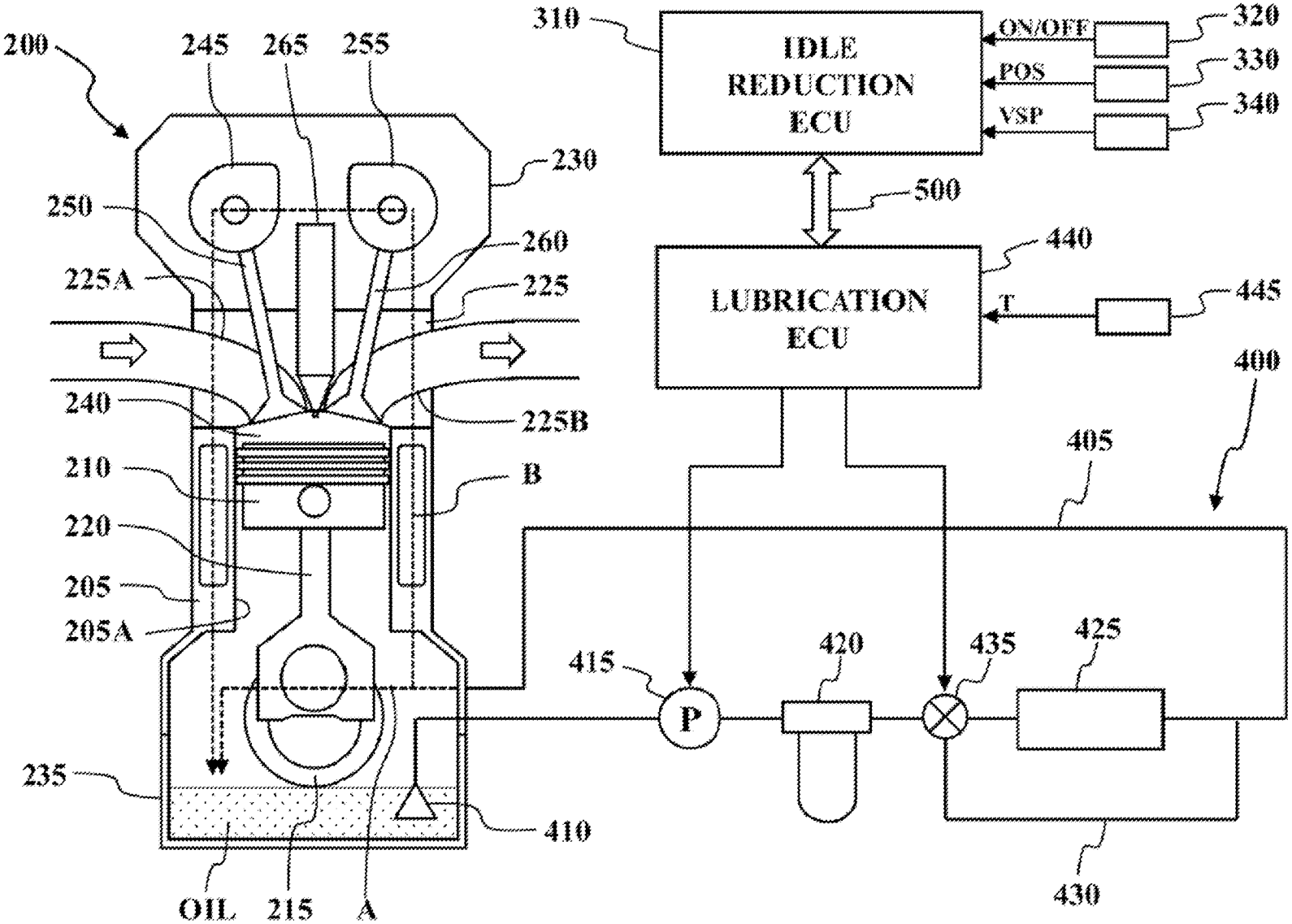
FIG. 2 is a schematic diagram of an example of an engine and a lubricating system.

As shown in FIG. 2, the engine 200 includes a cylinder block 205, pistons 210, a crankshaft 215, connecting rods 220, a cylinder head 225, a cylinder head cover 230, and an oil pan 235. The cylinder block 205 has cylinder bores 205A into which the pistons 210 are reciprocally fitted. The crankshaft 215 is disposed below the cylinder block 205 with bearings (not shown) interposed therebetween so as to be rotatable relative to the cylinder block 205. The pistons 210 are connected to the crankshaft 215 by means of the connecting rods 220 so as to be rotatable relative to the crankshaft 215.

The cylinder head 225 has intake ports 225A for introducing intake air and exhaust ports 225B for discharging exhaust gas. When the cylinder head 225 is fastened to the upper surface of the cylinder block 205, spaces are defined by the cylinder bores 205A of the cylinder block 205, the crown surfaces of the pistons 210, and the lower surface of the cylinder head 225. These spaces function as combustion chambers 240. Intake valves 250 configured to be opened and closed by an intake camshaft 245 are disposed at open ends, facing the combustion chambers 240, of the intake ports 225A. Exhaust valves 260 configured to be opened and closed by an exhaust camshaft 255 are disposed at open ends, facing the combustion chambers 240, of the exhaust ports 225B. In addition, fuel injectors 265 for injecting high-pressure fuel into the combustion chambers 240 are mounted at predetermined positions, facing the combustion chambers 240, of the cylinder head 225. As the fuel injectors 265, common rail fuel injectors may be used, for example.

The cylinder head cover 230 for covering the valvetrain including the intake camshaft 245 and the exhaust camshaft 255 is detachably fastened to the upper surface of the cylinder head 225. The oil pan 235 is configured to store a predetermined amount of lubricating oil OIL for lubricating components such as the bearings of the crankshaft 215, the pistons 210, and the valve valvetrain. The oil pan 235 is detachably fastened to the lower surface of the cylinder block 205.

The idle reduction system 300 includes an electronic idle reduction control unit 310. When the brake pedal is depressed and the vehicle speed falls below a predetermined vehicle speed, the electronic idle reduction control unit 310 outputs an engine stop command to the electronic engine control unit. When the depression of the brake pedal is released, the electronic idle reduction control unit 310 outputs an engine restart command to the electronic engine control unit. As shown in FIG. 3, the electronic idle reduction control unit 310 includes therein a processor 310A such as a central processing unit (CPU), a non-volatile memory 310B, a volatile memory 310C, an input/output circuit 310D, a communication circuit 310E, and an internal bus 310F for communicatively connecting these components with each other.

The processor 310A is hardware that executes a set of instructions (e.g., for data transfer, arithmetic processing, data processing, and data control and management) described in an application program. The processor 310A includes an arithmetic unit, a register that stores instructions and data, peripheral circuits, and the like. The non-volatile memory 310B is formed, for example, of a flash read only memory (ROM), which is capable of retaining data even after it is powered off. The non-volatile memory 310B retains an application program (control program) for implementing a control unit of the idle reduction system 300. The volatile memory 310C is formed, for example, of a dynamic random access memory (RAM), which loses data retained therein when it is powered off. The volatile memory 310C serves as a temporary storage area for data from arithmetic operations of the processor 310A.

The input/output circuit 310D includes an A/D converter, a D/A converter, a D/D converter, and the like. The input/output circuit 310D provides functionality to input and output analog and digital signals to external devices. The communication circuit 310E may include a controller area network (CAN) transceiver, for example. The communication circuit 310E provides functionality to connect to an on-board network of the vehicle. The internal bus 310F serves as a path for exchanging data between the components connected thereto. The internal bus 310F includes an address bus for transferring addresses, data bus for transferring data, and a control bus for exchanging control information and information on when to actually perform input/output operations through the address bus and/or the data bus.

Through the input/output circuit 310D, the electronic idle reduction control unit 310 receives output signals from an idle reduction switch 320, a pedal stroke sensor 330, and a vehicle speed sensor 340. The idle reduction switch 320 for selection to activate or deactivate the idle reduction system as necessary is mounted at a position facing the driver's seat of the truck 100, for example. The idle reduction switch 320 outputs an "ON" signal to activate the idle reduction system 300 and outputs an "OFF" signal to deactivate the idle reduction system 300. The pedal stroke sensor 330 is mounted near the brake pedal, for example, and outputs a brake pedal position POS. The vehicle speed sensor 340 is mounted to the output shaft of the transmission, for example, and outputs a vehicle speed VSP.

FIG. 4 shows an example of idle reduction control processing triggered by the activation of the electronic idle reduction control unit 310 and repeatedly performed by the processor 310A every first predetermined time in accordance with the application program stored in the non-volatile memory 310B.

In step 1 (abbreviated as "S1" in FIG. 4, the same applies to the other steps below), the processor 310A reads the output signal from the idle reduction switch 320 and determines whether the idle reduction switch 320 is ON. When the processor 310A determines that the idle reduction switch 320 is ON, i.e., determines to activate the idle reduction system 300 (Yes), the operation proceeds to step 2. When the processor 310A determines that the idle reduction switch 320 is OFF, i.e., determines to deactivate the idle reduction system 300 (No), the idle reduction control processing ends.

In step 2, the processor 310A reads the output signal from the pedal stroke sensor 330 and determines whether the brake pedal is depressed, based on the brake pedal position POS. When the processor 310A determines that the brake pedal is depressed (Yes), the operation proceeds to step 3. When the processor 310A determines that the brake pedal is not depressed (No), the idle reduction control processing ends.

In step 3, the processor 310A reads the output signal from the vehicle speed sensor 340 and determines whether the vehicle speed VSP is less than a predetermined vehicle speed. Here, the predetermined vehicle speed is a threshold for determining whether the truck 100 has substantially stopped. For example, the predetermined vehicle speed may be specified in consideration of the resolution of the vehicle speed sensor 340 and/or the like. When the processor 310A determines that the vehicle speed VSP is less than the predetermined vehicle speed (Yes), the operation proceeds to step 4. When the processor 310A determines that the vehicle speed VSP is equal to or higher than the predetermined vehicle speed (No), the idle reduction control processing ends.

In step 4, the processor 310A outputs the engine stop command to the electronic engine control unit. Upon receiving the engine stop command, the electronic engine control unit stops the engine 200 by, for example, controlling the fuel injectors 265 as appropriate.

In step 5, the processor 310A reads the output signal from the pedal stroke sensor 330 and determines whether the depression of the brake pedal is released, based on the brake pedal position POS. When the processor 310A determines that the depression of the brake pedal is released (Yes), the operation proceeds to step 6. When the processor 310A determines that the depression of the brake pedal is not released (No), the processor 310A waits until the release of the brake pedal is detected.

In step 6, the processor 310A outputs the engine restart command to the electronic engine control unit. Upon receiving the engine restart command, the electronic engine control unit restarts the engine 200 by, for example, controlling the starting motor and the fuel injectors 265 as appropriate. Then, the idle reduction control processing ends.

According to the idle reduction control processing described above, when the idle reduction switch 320 is ON, the following operations are performed. When the brake pedal is depressed and the vehicle speed VSP falls below the predetermined vehicle speed, the engine stop command is output to the electronic engine control unit. Then, when the depression of the brake pedal is released, the engine restart command is output to the electronic engine control unit. As such, the idle reduction control processing described above enables fuel saving and emission reduction by stopping the engine 200 while the vehicle is parking, stopping, or waiting for a traffic light. It should be noted that the above example of the idle reduction control processing is a merely illustrative example outlining the idle reduction control processing.

The lubricating system 400 includes an oil passage 405, as well as an oil strainer 410, an electric oil pump 415, an oil filter 420, and an oil cooler 425 which are disposed in this order along the oil passage 405. The lubricating oil OIL in the oil pan 235 circulates through the oil passage 405. The oil strainer 410 is configured to filter relatively large foreign matter contained in the lubricating oil OIL. For example, the oil strainer 410 may be made of a metal wire mesh. The oil pump 415 is configured to pump the lubricating oil OIL that has passed through the oil strainer 410. The oil pump 415 is driven by an electric motor (not shown) so that the lubricating oil OIL can be circulated even when the engine is stopped by the idle reduction system 300. The oil filter 420 is configured to filter relatively small foreign matter, such as sludge, contained in the lubricating oil OIL pumped by the oil pump 415. For example, the oil filter 420 may be made of a cylindrical filter paper with many folds. The oil cooler 425 is configured to cool the lubricating oil OIL that has passed through the oil filter 420. For example, the oil cooler 425 may be a water-based cooler having a stable cooling capacity.

The lubricating system 400 further includes a bypass passage 430 that bypasses the oil cooler 425. A remotely operable valve 435, such as a solenoid valve, is disposed at the branch point at which the oil passage 405 branches to the bypass passage 430, thus being disposed upstream of the oil cooler 425. The valve 435 allows switching the flow path of the lubricating oil OIL exclusively between flowing through the oil cooler 425 and flowing through the bypass passage 430.

The lubricating oil OIL having passed through the oil passage 405 is introduced into a main gallery (not shown) formed in the engine 200. Then, a part of the lubricating oil OIL passes through a first oil gallery A while lubricating the bearings supporting the crankshaft 215, the connecting rods 220, the pistons 210, and the like, and then returns to the oil pan 235. The remaining part of the lubricating oil OIL that is introduced into the main gallery passes through a second oil gallery B while lubricating the valvetrain and the like, and then returns to the oil pan 235. The first oil gallery A and the second oil gallery B constitute a part of the lubricating system 400.

The lubricating system 400 further includes an electronic lubrication control unit 440 (electronic control unit) configured to control the oil pump 415 and the valve 435 so that the temperature of the lubricating oil OIL approaches a target temperature. As shown in FIG. 5, the electronic lubrication control unit 440 includes therein a processor 440A such as a CPU, a non-volatile memory 440B, a volatile memory 440C, an input/output circuit 440D, a communication circuit 440E, and an internal bus 440F for communicatively connecting these components with each other. Note that the configuration of the electronic lubrication control unit 440 is basically the same as that of the electronic idle reduction control unit 310 and thus will not be further described so as to avoid redundant description. Please also refer to the above description for the electronic idle reduction control unit 310, if necessary.

Through the input/output circuit 440D, the electronic lubrication control unit 440 receives an output signal from a temperature sensor 445. The temperature sensor 445 is configured to measure the temperature (oil temperature) T of the lubricating oil OIL. Through the communication circuit 440E that provides connection, for example, to a CAN 500, the electronic lubrication control unit 440 is communicatively connected to the electronic idle reduction control unit 310, the electronic engine control unit (not shown), and the like.

In accordance with the operating state of the engine 200, the electronic lubrication control unit 440 controls the oil pump 415 so that the lubricating oil OIL is supplied to the movable components of the engine 200 and lubricates them as appropriate. In addition, the electronic lubrication control unit 440 also controls the valve 435 so that the oil temperature T measured by the temperature sensor 445 approaches the target temperature.

FIG. 6 shows an example of temperature control processing triggered by the activation of the electronic lubrication control unit 440 and repeatedly performed by the processor 440A every second predetermined time in accordance with the application program stored in the non-volatile memory 440B. Upon the activation of the electronic lubrication control unit 440, the target temperature of the lubrication oil OIL is set to a relatively high target temperature $T_H$ capable of reducing the friction of the engine 200. The second predetermined time may be equal to the first predetermined time, or may be different from the first predetermined time (the same also applies to "third predetermined time" below).

In step 11, the processor 440A determines whether the temperature sensor 445 operates properly by using, for example, a self-diagnostic function implemented in the electronic lubrication control unit 440. When the processor 440A determines that the temperature sensor 445 operates properly (Yes), the operation proceeds to step 12. When the processor 440A determines that the temperature sensor 445 does not operate properly (No), the processor 440A decides that it is unable to cause the temperature of the lubricating oil OIL to approach the target temperature, and the temperature control processing ends. As such, if the temperature sensor 445 does not operate properly, the valve 435 may be controlled so that the lubricating oil OIL flows through the oil cooler 425 in order to prevent an excessive rise of the temperature of the lubricating oil OIL, for example.

In step 12, the processor 440A reads the oil temperature T from the temperature sensor 445.

In step 13, the processor 440A determines whether the oil temperature T is higher than the target temperature. When the processor 440A determines that the oil temperature T is higher than the target temperature (Yes), the operation proceeds to step 14. When the processor 440A determines that the oil temperature T is equal to or lower than the target temperature (No), the operation proceeds to step 15.

In step 14, the processor 440A controls the valve 435 so that the lubricating oil OIL flows through the oil cooler 425. Then, the temperature control processing ends.

In step 15, the processor 440A controls the valve 435 so that the lubricating oil OIL flows through the bypass passage 430. Then, the temperature control processing ends.

According to the temperature control processing described above, when the temperature sensor 445 operates properly, the following operations are performed. When the oil temperature T is higher than the target temperature, the processor 440A of the electronic lubrication control unit 440 controls the valve 435 so that the lubrication oil OIL flows through the oil cooler 425. As a result, the lubricating oil OIL is cooled while flowing through the oil cooler 425, and this ensures that the temperature of the lubricating oil OIL is controlled to be equal to or lower than the target temperature. On the other hand, when the oil temperature T is equal to or lower than the target temperature, the processor 440A of the electronic lubrication control unit 440 controls the valve 435 so that the lubrication oil OIL flows through the bypass passage 430. Causing the lubricating oil OIL to flow through the bypass passage 430 that bypasses the oil cooler 425 prevents the lubricating oil OIL from being cooled excessively and falling below the target temperature. As a result, the viscosity of the lubricating oil OIL is reduced and this provides benefits such as improving fuel economy.

FIGS. 7 and 8 show an example of target temperature changing processing triggered by the activation of the electronic lubrication control unit 440 and repeatedly performed by the processor 440A every third predetermined time in accordance with the application program stored in the nonvolatile memory 440B. Note that the target temperature changing processing is performed only when the temperature sensor 445 operates properly.

In step 21, the processor 440A communicates with the electronic idle reduction control unit 310 and determines whether the idle reduction switch 320 is ON. When the processor 440A determines that the idle reduction switch 320 is ON (Yes), the operation proceeds to step 22. When the processor 440A determines that the idle reduction switch 320 is OFF (No), the operation proceeds to step 25.

In step 22, the processor 440A communicates with the electronic idle reduction control unit 310 and determines whether the engine 200 has already experienced an automatic stop by the idle reduction system 300 in the current driving cycle. As used herein, one driving cycle corresponds to a period from when the engine 200 is started by turning on the ignition switch (not shown) to when the engine 200 is stopped. When the processor 440A determines that the engine 200 has already experienced an automatic stop by the idle reduction system 300 in the current driving cycle (Yes), the operation proceeds to step 23. When the processor 440A determines that the engine 200 has not yet been experienced an automatic stop by the idle reduction system 300 in the current driving cycle (No), the operation proceeds to step 25.

In step 23, the processor 440A communicates with the electronic engine control unit and determines whether an average torque of the engine 200 is less than a first predetermined threshold mi. Here, the average torque of engine 200 may be a moving average torque over a predetermined period. When the processor 440A determines that the average torque of the engine 200 is less than the first predetermined threshold $Th_1$ (Yes), the operation proceeds to step 24. When the processor 440A determines that the average torque of the engine 200 is not less than the first predetermined threshold $Th_1$; that is, determines that the average torque of the engine 200 is equal to or more than the first predetermined threshold $Th_1$ (No), the operation proceeds to step 25.

In step 24, the processor 440A lowers the target temperature, that is, sets the target temperature to a relatively low target temperature $T_L$. Then, the target temperature changing processing ends.

In step 25, the processor 440A determines whether the target temperature is set to the relatively low target temperature $T_L$, that is, whether the target temperature is lowered. When the processor 440A determines that the target temperature is lowered (Yes), the operation proceeds to step 26. When the processor 440A determines that the target temperature is not lowered (No), the target temperature changing processing ends.

In step 26, the processor 440A communicates with the electronic engine control unit and determines whether the average torque of the engine 200 is greater than a second predetermined threshold $Th_2$. Here, the second predetermined threshold $Th_2$ differs from the first predetermined threshold $Th_1$. That is, the second predetermined threshold $Th_2$ is higher or lower than the first predetermined threshold $Th_1$ by a predetermined value. When the processor 440A determines that the average torque of the engine 200 is greater than the second predetermined threshold $Th_2$ (Yes), the operation proceeds to step 28. When the processor 440A determines that the average torque of the engine 200 is equal to or less than the second predetermined threshold $Th_2$ (No), the operation proceeds to step 27.

In step 27, the processor 440A communicates with the electronic idle reduction control unit 310 and determines whether the idle reduction switch 320 is OFF, that is, whether the idle reduction switch 320 is turned from ON to OFF. When the processor 440A determines that the idle reduction switch 320 is OFF (Yes), the operation proceeds to step 28. When the processor 440A determines that the idle reduction switch 320 remains ON (No), the target temperature changing processing ends.

In step 28, the processor 440A returns the target temperature to its initial value, that is, sets the target temperature to the relatively high target temperature $T_H$. Then, the target temperature changing processing ends.

According to the target temperature changing processing described above, when the idle reduction switch 320 is turned OFF by the driver's choice or the like, the target temperature is set to $T_H$ so as to maintain the temperature of the lubricating oil OIL at a relatively high temperature and improve fuel economy.

On the other hand, when the idle reduction switch 320 is turned ON by the driver's choice or the like, it is determined whether the engine 200 has already experienced an automatic stop by the idle reduction system 300 in the current driving cycle; that is, whether an idle reduction operation has ever been performed in the current driving cycle. The idle reduction system 300 does not automatically stop the engine 200 while the engine 200 is warming up and thus the operation of the engine 200 has not yet been stabilized. Thus, by determining whether the idle reduction operation has ever been performed in the current driving cycle, it may be indirectly decided whether the engine 200 is currently warming up. When it is decided that the engine 200 is currently warming up, the target temperature is set to a relatively high temperature so as not to hinder the warm-up operation.

Furthermore, when it is determined that the idle reduction switch 320 is ON and the idle reduction operation has ever been performed in the current driving cycle, it is further determined whether the moving average torque of the engine 200 over the predetermined period is less than the first predetermined threshold $Th_1$. Here, when the average torque of the engine 200 is less than the first predetermined threshold $Th_1$, the cooling water temperature of the engine 200 is assumed to be relatively low. Thus, under this condition, the water-based oil cooler 425 is able to reliably reduce the temperature of the lubricating oil OIL. On the other hand, when the average torque is equal to or higher than the first predetermined threshold $Th_1$, the cooling water temperature is assumed to be relatively high. Thus, under this condition, simply lowering the target temperature might not help the water-based oil cooler 425 reduce the temperature of the lubricating oil OIL. As such, according to the target temperature changing processing described above, the cooling water temperature is indirectly estimated based on the average torque of the engine 200, and the target temperature is lowered only when the oil cooler 425 is able to reliably reduce the temperature of the lubricating oil OIL.

Thus, the target temperature of the lubricating oil OIL is lowered when the following conditions are satisfied: the idle reduction switch 320 is ON; the idle reduction operation has ever been performed in the current driving cycle; and the average torque of the engine 200 is less than the first predetermined threshold mi. Accordingly, the temperature of the lubricating oil OIL is controlled so that it approaches this lowered target temperature and thus, the viscosity of the lubricating oil OIL is maintained at a relatively high level. Under the condition in which the lubricating oil OIL has a high viscosity, it is possible to rapidly increase the pressure of the lubricating oil OIL even right after the engine 200 is restarted by the idle reduction system 300. This allows an adequate supply of the lubricating oil OIL to the movable components of the engine 200, thus preventing the engine from being restarted while these movable components have not yet been sufficiently lubricated.

After the target temperature is lowered to the relatively low target temperature $T_L$, the target temperature returns to the relatively high target temperature $T_H$ when the average torque of the engine 200 becomes greater than the second predetermined threshold $Th_2$ or when the idle reduction switch 320 is turned from ON to OFF by the driver's choice or the like. In other words, the average torque of the engine 200, which is one parameter for changing the target temperature, is compared with different threshold values, i.e., the first predetermined threshold $Th_1$ and the second predetermined threshold $Th_2$. This provides a control structure with hysteresis, thus preventing or reducing hunting in control, for example.

The application programs may be stored in a computer-readable medium such as an SD card or a USB memory and distributed on the market. As an alternative, the application programs may be stored in a storage at a node connected to the Internet or the like and distributed from this node. In this case, the storage at the node is understood as an example of the computer-readable medium.

It should be noted that one skilled in the art could have easily understood that some of the technical features in the above embodiment may be omitted, combined with any one or more technical features in another embodiment, and/or replaced with one or more well-known technical features to provide various alternative embodiments.

For example, the electronic lubrication control unit 440 may be incorporated in another electronic control unit such as an electronic engine control unit. Furthermore, instead of reading the brake pedal position POS from the pedal stroke sensor 330 and the vehicle speed VSP from the vehicle speed sensor 340, the electronic idle reduction control unit 310 may acquire the brake pedal position POS and the vehicle speed VSP through, for example, communication with another electronic control unit.

REFERENCE SIGNS LIST

100 Truck (Vehicle)
200 Engine
300 Idle reduction system
310 Electronic idle reduction control unit
320 Idle reduction switch
400 Lubricating system
425 Oil cooler
430 Bypass passage
435 Valve
440 Electronic lubrication control unit (Electronic control unit)
445 Temperature sensor

The invention claimed is:

1. A method for controlling a lubricating system of an engine equipped with an idle reduction system, the lubricating system including an oil cooler, a remotely operable valve configured to open and close a bypass passage that bypasses the oil cooler, and an electronic control unit, the method comprising the steps, performed by the electronic control unit, of:

controlling the valve so that a temperature of lubricating oil approaches a target temperature; and lowering the target temperature when an average torque of the engine is less than a first predetermined threshold.

2. The method for controlling the lubricating system according to claim 1, wherein lowering the target temperature comprises lowering the target temperature when the average torque of the engine is less than the first predetermined threshold and the engine has already experienced an automatic stop by the idle reduction system in a current driving cycle.

3. The method for controlling the lubricating system according to claim 1, wherein the average torque of the engine is a moving average torque of the engine over a predetermined period.

4. The method for controlling the lubricating system according to claim 1, the method further comprising the step, performed by the electronic control unit, of:

stopping lowering the target temperature when the average torque of the engine is greater than a second predetermined threshold that differs from the first predetermined threshold after lowering the target temperature.

5. The method for controlling the lubricating system according to claim 1, wherein the temperature of the lubricating oil is measured by a temperature sensor.

6. The method for controlling the lubricating system according to claim 5, wherein the steps of controlling the valve and lowering the target temperature are performed by the electronic control unit when the temperature sensor operates properly.

7. The method for controlling the lubricating system according to claim 1, wherein the idle reduction system further includes a switch for selection to activate or deactivate the idle reduction system, and wherein the steps of controlling the valve and lowering the target temperature are performed by the electronic control unit when activating the idle reduction system is selected using the switch.

8. The method for controlling the lubricating system according to claim 1, wherein the valve is disposed upstream of the oil cooler.

9. The method for controlling the lubricating system according to claim 1, wherein the oil cooler is water-based.

10. A controller of a lubricating system configured to perform the steps according to claim 1.

11. A program for controlling a lubricating system, the program comprising a program code which, when executed on a computer, causes the computer to perform the steps according to claim 1.

12. A computer-readable medium carrying a program for controlling a lubricating system, the program comprising a program code which, when executed on a computer, causes the computer to perform the steps according to claim 1.

13. A lubricating system of an engine equipped with an idle reduction system, the lubricating system comprising:

an oil cooler;

a remotely operable valve configured to open and close a bypass passage that bypasses the oil cooler; and an electronic control unit configured to control the valve so that a temperature of lubricating oil approaches a target temperature, and to lower the target temperature when an average torque of the engine is less than a predetermined threshold.

14. A vehicle equipped with the lubricating system according to claim 13.

* * * * *